US008785366B2

(12) United States Patent
Mondin et al.

(10) Patent No.: US 8,785,366 B2
(45) Date of Patent: Jul. 22, 2014

(54) LIQUID CLEANING COMPOSITIONS AND METHODS

(75) Inventors: Myriam Mondin, Seraing (BE); Didier Dormal, Aywaille (BE); Frederic Bessemans, Waret-l'eveque (BE); Jean Massaux, Olne (BE); Baudoin Mertens, Jambes (BE)

(73) Assignee: Colgate-Palmolive Company, New York, NY (US)

( * ) Notice: Subject to any disclaimer, the term of this patent is extended or adjusted under 35 U.S.C. 154(b) by 421 days.

(21) Appl. No.: 12/522,971

(22) PCT Filed: May 26, 2009 (Under 37 CFR 1.47)

(86) PCT No.: PCT/US2009/045151

§ 371 (c)(1), (2), (4) Date: Jan. 31, 2011

(87) PCT Pub. No.: WO2009/143513

PCT Pub. Date: Nov. 26, 2009

(65) Prior Publication Data

US 2011/0271979 A1 Nov. 10, 2011

Related U.S. Application Data

(60) Provisional application No. 61/055,489, filed on May 23, 2008.

(51) Int. Cl.
*C11D 3/60* (2006.01)

(52) U.S. Cl.
USPC ..... 510/395; 510/399; 134/6

(58) Field of Classification Search
USPC ..... 510/395, 399; 134/6
See application file for complete search history.

(56) References Cited

U.S. PATENT DOCUMENTS

| | | | | |
|---|---|---|---|---|
| 2,503,280 | A | 4/1950 | Lockwood | |
| 2,507,088 | A | 5/1950 | Bradley | |
| 2,560,839 | A | 7/1951 | Ayo e al. | |
| 3,234,138 | A | 2/1966 | Carroll et al. | |
| 3,260,744 | A | 7/1966 | Ito et al. | |
| 3,320,174 | A | 5/1967 | Rubinfeld | |
| 3,350,319 | A | 10/1967 | Schonfeldt | |
| 3,372,188 | A | 3/1968 | Alston et al. | |
| 3,723,330 | A | 3/1973 | Sheflin | |
| 3,929,678 | A | 12/1975 | Laughlin et al. | |
| 3,935,130 | A | 1/1976 | Hirano et al. | |
| 4,017,409 | A | 4/1977 | Demessemaekers et al. | |
| 4,244,840 | A * | 1/1981 | Straw | 510/416 |
| 4,414,128 | A | 11/1983 | Goffinet | |
| 4,472,291 | A | 9/1984 | Rosano | |
| 4,540,448 | A | 9/1985 | Gautier et al. | |
| 4,540,505 | A | 9/1985 | Frazier | |
| 4,561,991 | A | 12/1985 | Herbots et al. | |
| 4,565,647 | A | 1/1986 | Llenado | |
| 4,576,744 | A | 3/1986 | Edwards et al. | |
| 4,869,842 | A * | 9/1989 | Denis et al. | 510/365 |
| 4,880,558 | A | 11/1989 | Jost et al. | |
| 5,531,933 | A | 7/1996 | Masters et al. | |
| 5,716,925 | A | 2/1998 | Mondin et al. | |
| 5,720,964 | A | 2/1998 | Murray | |
| 5,834,413 | A | 11/1998 | Broze et al. | |
| 5,858,948 | A | 1/1999 | Ghosh et al. | |
| 6,150,319 | A | 11/2000 | Mertens et al. | |
| 6,159,925 | A * | 12/2000 | Blandiaux | 510/437 |
| 6,288,019 | B1 * | 9/2001 | Mertens et al. | 510/417 |
| 6,331,517 | B1 * | 12/2001 | Durbut | 510/426 |
| 6,369,012 | B1 | 4/2002 | Kasturi et al. | |
| 6,664,218 | B1 | 12/2003 | Dastbaz et al. | |
| 6,703,358 | B1 | 3/2004 | Aubay et al. | |
| 7,049,281 | B2 * | 5/2006 | Mondin et al. | 510/475 |
| 7,307,055 | B2 * | 12/2007 | Cook et al. | 510/438 |
| 2004/0204332 | A1 * | 10/2004 | Dastbaz et al. | 510/438 |
| 2005/0065056 | A1 | 3/2005 | Cook | |

FOREIGN PATENT DOCUMENTS

| | | | |
|---|---|---|---|
| DE | 735096 | | 5/1943 |
| EP | 0 021 545 | A | 1/1981 |
| EP | 0 080 749 | A | 6/1983 |
| EP | 0137615 | | 4/1985 |
| EP | 0137616 | | 4/1985 |
| EP | 0160762 | | 11/1985 |
| EP | 0 335 471 | A | 10/1989 |
| EP | 1167500 | A1 | 1/2002 |
| GB | 1223739 | | 3/1971 |
| GB | 1603047 | | 11/1981 |
| GB | 2144763 | | 3/1985 |
| WO | 91/08282 | A | 6/1991 |
| WO | 9206171 | A | 4/1992 |
| WO | 94/05757 | A | 3/1994 |
| WO | 9850508 | A | 11/1998 |
| WO | 99/03957 | A | 1/1999 |
| WO | WO 99/21530 | | 5/1999 |
| WO | 01/77278 | A | 10/2001 |

OTHER PUBLICATIONS

International Search Report PCT/US2009/045151 mailed Oct. 12, 2009.

* cited by examiner

*Primary Examiner* — Nicole M Buie-Hatcher
*Assistant Examiner* — M. Reza Asdjodi
(74) *Attorney, Agent, or Firm* — Michael F. Morgan

(57) ABSTRACT

Cleaning compositions of surfactant-based products containing one or more alkaline builders for the preparation of liquid cleaning compositions are discussed. The surfactant-based product may be any type of cleaning product based on surfactants. Methods of cleaning a household surface and of making cleaning compositions are also discussed.

17 Claims, No Drawings

LIQUID CLEANING COMPOSITIONS AND METHODS

CROSS REFERENCE TO RELATED APPLICATIONS

This application claims priority to U.S. Application Ser. No. 61/055,489, filed on 23 May 2008, which is incorporated herein by reference.

BACKGROUND OF THE INVENTION

Cleaning compositions useful for purposes such as household cleaning are generally known in the art. Typically, these cleaning materials are available in various forms, including "neat" (i.e., ready to use) or dilutable forms.

However, there is an ongoing need for improved cleaning compositions that are easy to use and exhibit desirable properties such as foaming and excellent ability to remove soils such as grease and dirt. Furthermore, formulations that are easy to formulate and economical to purchase are continuously desirable.

BRIEF SUMMARY OF THE INVENTION

A cleaning composition comprising:

(i) an ethoxylated or propoxylated nonionic surfactant;
(ii) an anionic surfactant;
(iii) a maleic acid-olefin copolymer;
(iv) a fatty acid or a salt thereof;
(v) an alkaline builder;
(vi) a thickening agent; and
(vii) an abrasive material.

A cleaning composition comprising:

(i) about 0.1 wt. % to about 10 wt. % ethoxylated or propoxylated nonionic surfactant;
(ii) about 0.01 wt. % to about 8 wt. % anionic surfactant;
(iii) about 0.01 wt. % to about 3 wt. % maleic acid-olefin copolymer;
(iv) about 0.01 wt. % to about 3 wt. % of a $C_{10}$-$C_{22}$ carboxylic acid sodium salt;
(v) about 0.01 wt. % to about 3 wt. % alkaline builder chosen from alkali metal or alkaline earth metal phosphates, pyrophosphates, phosphonates, citrates, silicates, borates, carbonates, hydroxides, bicarbonates; monoethanolamine, diethanolamine, triethanolamine; sodium tripolyphosphate; trisodium phosphate; tetrasodium pyrophosphate; sodium acid pyrophosphate; sodium monobasic phosphate; sodium dibasic phosphate; sodium hexametaphosphate; sodium metasilicate; sodium silicates; sodium carbonate; sodium sulfate; borax (sodium tetraborate); ethylene diamine tetraacetic acid tetrasodium salt; and trisodium nitrilotriacetate;
(vi) about 0.01 wt. % to about 3 wt. % xanthan gum; and
(vii) about 0.01 wt. % to about 3 wt. % abrasive material chosen from chalk, silica, alumina, sodium silicate, zirconium silicate, sodium carbonate, sodium citrate or a mixture thereof.

A method of making a detergent comprising combining the following:

(i) about 0.01 wt. % to about 8 wt. % anionic surfactant;
(ii) about 0.1 wt. % to about 10 wt. % ethoxylated or propoxylated nonionic surfactant;
(iii) about 0.01 wt. % to about 3 wt. % copolymer;
(iv) about 0.01 wt. % to about 3 wt. % fatty acid or a salt thereof;

(v) about 0.01 wt. % to about 3 wt. % alkaline builder;
(vi) about 0.01 wt. % to about 3 wt. % thickening agent; and
(vii) about 0.01 wt. % to about 3% abrasive material.

DETAILED DESCRIPTION OF THE INVENTION

As used throughout, ranges are used as a shorthand for describing each and every value that is within the range. Any value within the range can be selected as the terminus of the range. All percentages expressed herein are percentages by weight unless otherwise indicated. In addition, all references cited herein are hereby incorporated by reference in their entireties. In the event of a conflict in a definition in the present disclosure and that of a cited reference, the present disclosure controls.

It has now been found that a cleaning composition can be formulated with one or more anionic surfactants, one or more ethoxylated or propoxylated nonionic surfactants, one or more copolymers, one or more fatty acids or a salt thereof, one or more alkaline builders, one or more thickening agents, and one or more abrasive materials, and that the resultant cleaning compositions possess desirable foaming and grease-cutting performance.

In certain embodiments, the present invention is directed to a composition comprising one or more anionic surfactants, one or more ethoxylated or propoxylated nonionic surfactants, one or more copolymers, one or more fatty acid or a salt thereof, one or more alkaline builders, one or more thickening agents, and one or more abrasive materials, which possess increased grease-cutting performance.

In certain embodiments, the compositions of the present invention comprise about 0.01 to about 8% by weight anionic surfactant, about 0.1 to about 10% ethoxylated or propoxylated nonionic surfactant, about 0.01% to about 3% copolymer, about 0.01% to about 3% fatty acid or a salt thereof, about 0.01% to about 3% alkaline builder, about 0.01% to about 3% thickening agent; and about 0.01% to about 3% abrasive material. The compositions may optionally compromise one or more solubilizing agents in an amount of about 0.01% to about 3%.

In certain embodiments, the invention is directed to a method of cleaning a surface, such as removing grease from a surface, which includes contacting the surface with a cleaning agent including one or more anionic surfactants, one or more ethoxylated or propoxylated nonionic surfactants, one or more copolymers, one or more fatty acid or a salt thereof, one or more alkaline builders, one or more thickening agents, and one or more abrasive materials. In certain embodiments, one or more of the ingredients of the present compositions imparts increased grease-cutting performance to the compositions.

In certain embodiments, the invention is directed to a method of making a cleaning composition with superior grease-cutting performance, which comprises combining about 0.01% to about 8% anionic surfactant, about 0.1% to about 10% ethoxylated or propoxylated nonionic surfactant, about 0.01% to about 3% copolymers, about 0.01% to 3% fatty acid or a salt thereof, about 0.01% to about 3% alkaline builders, about 0.01% to 3% thickening agents; and about 0.01% to about 3% abrasive materials.

In certain embodiments, the present invention relates to a cleaning composition that includes:

one or more anionic surfactants,
one or more ethoxylated or propoxylated nonionic surfactants,
one or more copolymers,
one or more fatty acid or a salt thereof, one or more alkaline builders, one or more thickening agents, and one or more abrasive materials, wherein the composition exhibits improved grease-cutting performance.

Anionic Surfactants

Suitable water-soluble non-soap, anionic surfactants include those surface-active or detergent compounds, that contain an organic hydrophobic group containing generally 8 to 26 carbon atoms and in certain embodiments 10 to 18 carbon atoms in their molecular structure and at least one water-solubilizing group, which in certain embodiments is sulfonate group.

In certain embodiments, the hydrophobic group includes a $C_8$-$C_{22}$ alkyl, alkyl or acyl group. Such surfactants may be employed in the form of water-soluble salts and the salt-forming cation may be sodium, potassium, ammonium, magnesium and mono-, di- or tri-$C_2$-$C_3$ alkanolammonium.

Examples of suitable sulfonated anionic surfactants include higher alkyl mononuclear aromatic sulfonates such as the higher alkyl benzene sulfonates containing from 10 to 16 carbon atoms in the higher alkyl group in a straight or branched chain, $C_8$-$C_{15}$ alkyl toluene sulfonates and $C_8$-$C_{15}$ alkyl phenol sulfonates.

In certain embodiments, the sulfonate surfactant is a linear alkyl benzene sulfonate having a high content of 3- (or higher) phenyl isomers and a correspondingly low content (well below 50%) of 2- (or lower) phenyl isomers, that is, wherein the benzene ring is attached in large part at the 3 or higher (for example, 4, 5, 6 or 7) position of the alkyl group and the content of the isomers in which the benzene ring is attached in the 2 or 1 position is correspondingly low. Examples of materials are set forth in U.S. Pat. No. 3,320,174.

Other suitable anionic surfactants include, for example, the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, or 12 to 21 carbon atoms and having the formula of Figure 1:

$$RCH{=}CHR_1$$

FIG. 1 where R is a higher alkyl group of 6 to 23 carbons and $R_1$ is an alkyl group of 1 to 17 carbons or hydrogen to form a mixture of sulfones and alkene sulfonic acids which is then treated to convert the sulfones to sulfonates. In certain embodiments, the olefin sulfonates contain from 14 to 16 carbon atoms in the R alkyl group and are obtained by sulfonating an α-olefin.

Other examples of operative anionic surfactants include, but are not limited to, sodium dialkyl sulfosuccinate [di-(2 ethylhexyl) sodium sulfosuccinate being one] and corresponding dihexyl and dialkyl esters. In certain embodiments, sulfosuccinic acid ester salts are esters of aliphatic alcohols such as saturated alkanols of 4 to 12 carbon atoms and are normally diesters of such alkanols. In other embodiments, alkali metal salts of the diesters of alcohols of 6 to 10 carbons atoms are utilized and in further embodiments, the diesters will be from octanol, such as 2-ethyl hexanol, and the sulfonic acid salt will be the sodium salt.

Other anionic sulfonate surfactants that can be used in the compositions and methods of the present invention are paraffin sulfonates containing 10 to 20, and in certain embodiments 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735,096.

Of the foregoing non-soap anionic sulfonate surfactants, certain illustrative embodiments utilize a magnesium salt of the $C_{13}$-$C_{17}$ paraffin or alkane sulfonates.

Generally, the proportion of the non-soap anionic surfactant will be, in various embodiments, about 0.1% to about 8%, about 1% to about 6% or about 1.5% to about 5% by weight of the composition.

Nonionic Surfactants

In various embodiments, the compositions of the present composition contain about 0.1% to about 10% or about 0.5% to about 6% of an ethoxylated nonionic surfactant. The water soluble aliphatic ethoxylated nonionic surfactants utilized in this invention are commercially known and may include the primary aliphatic alcohol ethoxylates and secondary aliphatic alcohol ethoxylates. In certain embodiments, the length of the polyethenoxy chain can be adjusted to achieve the desired balance between the hydrophobic and hydrophilic elements.

The nonionic surfactant class includes the condensation products of a higher alcohol (e.g., an alkanol containing about 8 to 16 carbon atoms in a straight or branched chain configuration) condensed with about 4 to 20 moles of ethylene oxide, for example, lauryl or myristyl alcohol condensed with about 10 moles of ethylene oxide (EO), tridecanol condensed with about 6 to 15 moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

Illustrative examples of the foregoing nonionic surfactants include, but are not limited to, the Neodol® ethoxylates (Shell Co.), which are higher aliphatic, primary alcohol containing about 9-15 carbon atoms, such as $C_9$-$C_{11}$ alkanol condensed with 4 to 10 moles of ethylene oxide (Neodol 91-8® or Neodol 91-5®), $C_{12-13}$ alkanol condensed with 6.5 moles ethylene oxide (Neodol 23-6.5®), $C_{12-15}$ alkanol condensed with 12 moles ethylene oxide (Neodol 25-12®), $C_{14-15}$ alkanol condensed with 13 moles ethylene oxide (Neodol 45-13®), and the like. Such ethoxamers have an HLB (hydrophobic lipophilic balance) value of about 8 to 15 and give good O/W emulsification, whereas ethoxamers with HLB values below 7 contain less than 4 ethyleneoxide groups and tend to be poor emulsifiers and poor detergents.

Additional satisfactory water soluble alcohol ethylene oxide condensates include, but are not limited to, the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type include $C_{11}$-$C_{15}$ secondary alkanol condensed with either 9 EO (Tergitol 15-S-9®) or 12 EO (Tergitol 15-S-12®) marketed by Union Carbide.

The water soluble ethoxylated or propoxylated nonionic surfactants that can be utilized in this invention are an aliphatic ethoxylated or propoxylated nonionic surfactants which are depicted by the formulas of Figure 2 or Figure 3:

FIG. 2

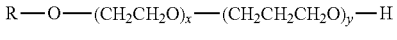

or

FIG. 3

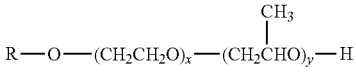

wherein R is a branched chain alkyl group having about 10 to about 16 carbon atoms, or an isotridecyl group and x and y are independently numbered from 1 to 20. In certain embodiments, the ethoxylated or propoxylated nonionic surfactant is Plurafac® LF 300 manufactured by BASF.

Polymers

The compositions and methods of the invention also include an agent for reducing the amount of residue left on the surface being cleaned.

In certain embodiments, the polymeric material improves the hydrophilicity of the surface being treated. The increase in hydrophilicity provides improved final appearance by providing "sheeting" of the water from the surface and/or spreading of the water on the surface. Another important feature of polymers is lack of residue upon drying. Compositions including polymers and copolymers of the invention dry more evenly on floors while promoting an end result with little or no haze.

This agent may be added to the composition at a concentration of about 0.05% to about 3.0%, in other embodiments about 0.1% to about 2.0%, wherein the agent is a sodium salt of a $C_8$ olefin/maleic acid copolymer having a molecular weight of about 5,000 to about 15,000, wherein the copolymer contains about 10% to about 90% of $C_8$ olefin monomer. Examples of commercially available copolymers of the foregoing type include Acusol 460 NK marketed by Rohm and Haas, and Sokalan CP9 sold by BASF.

Many materials can provide the sheeting and anti-spotting benefits, in certain embodiments the materials are polymers that contain amine oxide hydrophilic groups. Polymers that contain other hydrophilic groups such a sulfonate, pyrrolidone, and/or carboxylate groups can also be used. Examples of desirable poly-sulfonate polymers include polyvinylsulfonate and polystyrene sulfonate. A typical formula is as follows—$[CH(C_6H_4SO_3Na)—CH_2]n-CH(C_6H_5)—CH_2$——wherein n is a number to give the appropriate molecular weight as disclosed below.

In various embodiments, typical molecular weights are about 10,000 to about 1,000,000 or about 200,000 to about 700,000. Polymers containing pyrrolidone functionalities include polyvinyl pyrrolidone, quaternized pyrrolidone derivatives (such as Gafquat 755N from International Specialty Products), and co-polymers containing pyrrolidone, such as polyvinylpyrrolidone/dimethyl-aminoethylmethacrylate (available from ISP) and polyvinyl pyrrolidone/acrylate (available from BASF). Other materials can also provide substantivity and hydrophilicity including cationic materials that also contain hydrophilic groups and polymers that contain multiple ether linkages. Cationic materials may include cationic sugar and/or starch derivatives and the typical block copolymer detergent surfactants based on mixtures of polypropylene oxide and ethylene oxide are representative of the polyether materials. The polyether materials are less substantive, however.

The polymers of this invention possess the property of being substantive without leaving a visible residue that would render the surface substrate unappealing to consumers.

Some non-limiting examples of homopolymers and copolymers which can be used as polymers of the present invention are: adipic acid/dimethylaminohydroxy-propyl diethylenetriamine copolymer; adipic acid/epoxypropyl diethylenetriamine copolymer; polyvinyl alcohol; methacryloyl ethyl betaine/methacrylates copolymer; ethyl acrylate/methyl methacrylate/methacrylic acid/acrylic acid copolymer; polyamine resins; and polyquaternary amine resins; poly(ethenylformamide); poly(vinylamine) hydrochloride; poly(vinyl alcohol-co-6% vinylamine); poly(vinyl alcohol-co-12% vinylamine); poly(vinyl alcohol-co-6% vinylamine hydrochloride); and poly(vinyl alcohol-co-12% vinylamine hydrochloride). The copolymer and/or homopolymers are selected from the group consisting of adipic acid/dimethylaminohydroxypropyl diethylenetriamine copolymer; poly(vinylpyrrolidone/dimethylaminoethyl methacrylate); polyvinyl alcohol; ethyl acrylate/methyl methacrylate/methacrylic acid/acrylic acid copolymer; methacryloyl ethyl betaine/methacrylates copolymer; polyquaternary amine resins; poly(ethenylformamide); poly(vinylamine) hydrochloride; poly(vinyl alcohol-co-6% vinylamine); poly(vinyl alcohol-co-12% vinylamine); poly(vinyl alcohol-co-6% vinylamine hydrochloride); and poly(vinyl alcohol-co-12% vinylamine hydrochloride).

Polymers useful in the present invention include copolymers of hydrophilic monomers. The polymer can be linear random or block copolymers, and mixtures thereof. The term "hydrophilic" is used herein consistent with its standard meaning of having affinity for water. As used herein in relation to monomer units and polymeric materials, including the copolymers, "hydrophilic" means substantially water soluble. In this regard, "substantially water soluble" shall refer to a material that is soluble in distilled (or equivalent) water, at 25° C., at a concentration of about 0.2% by weight, and are soluble at about 1% by weight. The terms "soluble", "solubility" and the like, for purposes hereof, correspond to the maximum concentration of monomer or polymer, as applicable, which can dissolve in water or other solvents to form a homogeneous solution, as is well understood to those skilled in the art.

Nonlimiting examples of useful hydrophilic monomers are unsaturated organic mono- and polycarboxylic acids, such as acrylic acid, methacrylic acid, crotonic acid, maleic acid and its half esters, itaconic acid; unsaturated alcohols, such as vinyl alcohol, allyl alcohol; polar vinyl heterocyclics, such as, vinyl caprolactam, vinyl pyridine, vinyl imidazole; vinyl amine; vinyl sulfonate; unsaturated amides, such as acrylamides, N,N-dimethylacrylamide, N-t-butyl acrylamide; hydroxyethyl methacrylate; dimethylaminoethyl methacrylate; salts of acids and amines listed above; and the like; and mixtures thereof. Some hydrophilic monomers include acrylic acid, methacrylic acid, N,N-dimethyl acrylamide, N,N-dimethyl methacrylamide, N-t-butyl acrylamide, dimethylamino ethyl methacrylate, thereof, and mixtures thereof.

Polycarboxylate polymers are those formed by polymerization of monomers, at least some of which contain carboxylic functionality. Common monomers include acrylic acid, maleic acid, ethylene, vinyl pyrrolidone, methacrylic acid, methacryloyl-ethylbetaine. Polymers for substantivity are those having higher molecular weights. For example, polyacrylic acid having molecular weights below about 10,000 are not particularly substantive and therefore do not normally provide hydrophilicity for the rewettings with all compositions, although with higher levels and/or certain surfactants like amphoteric and/or zwitterionic detergent surfactants, molecular weights down to about 1000 can provide some results. In various embodiments, the polymers may have molecular weights of more than about 10,000, more than about 20,000, more than about 300,000, or more than about 400,000. It has also been found that higher molecular weight polymers, e.g., those having molecular weights of more than about 3,000,000, are extremely difficult to formulate and less effective in providing anti-spotting benefits than lower molecular weight polymers. Accordingly, in various embodiments the molecular weight may be (especially for polyacrylates) about 20,000 to about 3,000,000; about 20,000 to about 2,500,000; about 300,000 to about 2,000,000; or about 400,000 to about 1,500,000.

Fatty Acids

The addition of fatty acid or fatty acid soap may provide superior rinseability of the composition, whether applied in neat or diluted form. Generally, however, it is added to increase the level of cosurfactant to maintain product stability when the fatty acid or soap is present.

The fatty acid or a salt thereof of the invention is generally a mixture of sodium salts of various naturally occurring fatty acids. Air bubbles added to a molten soap will decrease the density of the soap and thus it will float on water. If the fatty acid or a salt thereof has potassium rather than sodium, a softer lather is the result.

The fatty acid soaps of the invention produced by a saponification or basic hydrolysis reaction of a fat or oil. Currently, sodium carbonate or sodium hydroxide is used to neutralize the fatty acid and convert it to the salt.

General Overall Hydrolysis Reaction:

fat+NaOH--->glycerol+sodium salt of fatty acid

Although the reaction is shown as a one step reaction, it is in fact two steps. The net effect as that the ester bonds are broken. The glycerol turns back into an alcohol. The fatty acid portion is turned into a salt because of the presence of a basic solution of the NaOH. In the carboxyl group, one oxygen now has a negative charge that attracts the positive sodium ion.

The type of fatty acid and length of the carbon chain determines the unique properties of various soaps of the invention. Tallow or animal fats give primarily sodium stearate (18 carbons) a very hard, insoluble soap. Fatty acids with longer chains are even more insoluble. As a matter of fact, zinc stearate is used in talcum powders because it is water repellent.

Coconut oil is a source of lauric acid (12 carbons) which can be made into sodium laurate. This soap is very soluble and will lather easily even in sea water.

As example of the fatty acids which can be used as such or in the form of soap, mention can be made of distilled coconut oil fatty acids, "mixed vegetable" type fatty acids (e.g. high percent of saturated, mono- and/or polyunsaturated $C_{18}$ chains); oleic acid, stearic acid, palmitic acid, eiocosanoic acid, and the like, generally those fatty acids having from 8 to 22 carbon atoms being acceptable.

In certain embodiments, the compositions of the present invention comprise a sodium soap (also referred to as sodium cocoate), which is a material that may be generated from the neutralization of coco fatty acid by a base such as caustic soda (NaOH). In certain embodiments, the sodium soap used is a $C_{12-18}$ fatty acid sodium soap.

In various embodiments, the cleaning compositions may include up to about 2.0%, or about 0.1% to about 1% by weight of the composition of a $C_{10}$-$C_{22}$ fatty acid or fatty acid soap as a foam suppressant.

Alkaline Builders

The compositions of the invention also include one or more alkaline builders. Alkaline builders are water soluble bases added to detergent compositions to raise the pH of the cleaning solution. The alkaline builders of the invention in certain embodiments have cleaning ability of their own, and they improve the function of the surfactants.

In various embodiments, the compositions of this invention include about 0.01 to about 3 percent by weight or about 0.1 to about 2.5 percent by weight of the alkaline builder. These materials are suspended in the mass of the solid detergent during the production process. The amount of alkaline builder used will depend on the relative amounts of surfactants desired to achieve the proper cleaning effect.

In certain embodiments, powdered, bead, liquid or granular alkaline builders can be used in the formulation of detergents of the invention. Generally, any water soluble base is appropriate, although certain bases are commonly used as alkaline builders in detergent compositions. Some alkaline builders that can be included compositions of the invention include, but are not limited to, sodium or potassium silicate, sodium or potassium carbonate, trisodium or tripotassium phosphate, $Na_2HPO_4$, $K_2HPO_4$, sodium hydroxide, potassium hydroxide, monoethanolamine diethanolamine, triethanolamine.

Solubilizing Agents

In certain embodiments, the compositions of the invention may comprise one or more solubilizing agents. Solubilizing agent such as ethanol, hexylene glycol, pentaethylene glycol hexyl ether, triethylene glycol hexyl ether, sodium chloride and/or sodium cumene or sodium xylene sulfonate may be used to assist in solubilizing the surfactants.

In various embodiments, the compositions of this invention may include about 0.01% to about 3%, about 0.5% to about 2% or about 0.75% to about 1.25% by weight of solubilizing agent.

Thickening Agents

The composition also includes a thickener or thickening agent (as used herein, the terms "thickener" and "thickening agent" are used interchangeably). Suitable thickeners may be organic or inorganic in nature. The thickener may thicken the composition by either thickening the aqueous portions of the composition, or by thickening the non-aqueous portions of the composition. In certain embodiments, the composition is not an emulsion.

Thickeners that may be useful for the embodiments of the present invention may be divided into organic and inorganic thickeners. Organic thickeners may include (1) cellulosic thickeners and their derivatives, (2) natural gums, (3) acrylates, (4) starches, (5) stearates, and (6) fatty acid alcohols. Inorganic thickeners may include (7) clays, and (8) salts. Some non-limiting examples of cellulosic thickeners include carboxymethyl hydroxyethylcellulose, cellulose, hydroxybutyl methylcellulose, hydroxyethylcellulose, hydroxypropylcellulose, hydroxypropyl methyl cellulose, methylcellulose, microcrystalline cellulose, sodium cellulose sulfate, and the like. Some non-limiting examples of natural gums include acacia, calcium carrageenan, guar, gelatin, guar gum, hydroxypropyl guar, karaya gum, kelp, locust bean gum, pectin, sodium carrageenan, tragacanth gum, xanthan gum, and the like. Some non-limiting examples of acrylates include potassium aluminum polyacrylate, sodium acrylate/vinyl alcohol copolymer, sodium polymethacrylate, and the like. Some non-limiting examples of starches include oat flour, potato starch, wheat flour, wheat starch, and the like. Some non-limiting examples of stearates include methoxy PEG-22/dodecyl glycol copolymer, PEG-2M, PEG-5M, and the like. Some non-limiting examples of fatty acid alcohols include caprylic alcohol, cetearyl alcohol, lauryl alcohol, oleyl alcohol, palm kernel alcohol, and the like. Some non-limiting examples of clays include bentonite, magnesium aluminum silicate, magnesium trisilicate, stearalkonium bentonite, trimethylamine magnesium aluminum silicate, and the like. Some non-limiting examples of salts include calcium chloride, sodium chloride, sodium sulfate, ammonium chloride, and the like.

Some non-limiting examples of thickeners that may be used to thicken the non-aqueous portions of the composition include waxes such as candelilla wax, carnauba wax, beeswax, and the like, oils, vegetable oils and animal oils, and the like.

The composition may contain one thickener or a mixture of two or more thickeners. The thickeners should be selected such that they do not adversely react with the other components or compounds of the invention or otherwise render the composition of the invention ineffective. It is understood that a person skilled in the art will know how to select an appropriate thickener and control any adverse reactions through formulating.

The amount of thickener present in the composition depends on the desired viscosity of the composition. In various embodiments, the composition may have a viscosity of about 100 to about 15,000 centipoise, about 150 to about 10,000 centipoise, or about 200 to about 5,000 centipoise as determined using a Brookfield DV-11+rotational viscometer using spindle #21 at 20 rpm at 70 degrees F. (21.1 degrees C.). Accordingly, to achieve the desired viscosities, in various embodiments the thickener may be present in the composition in an amount of about 0.001% to about 5%, about 0.01% to about 3%, or about 0.05% to about 2% of the total composition.

Thickeners from the above-mentioned classes of substance are commercially broadly available and are obtainable, for example, under the trade names Acusol®820 (methacrylic acid (stearyl alcohol-20 EO) ester-acrylic acid copolymer, 30% active in water, Rohm & Haas), Dapral®-GT-282-S (alkyl polyglycol ether, Akzo), Deuterol® polymer-11 (dicarboxylic acid copolymer, Schoner GmbH), Deuteron® XG (anionic heteropolysaccharide based on beta-D-glucose, D-manose, D-glucuronic acid, Schoner GmbH), Deuteron®-XN (nonionogenic polysaccharide, Schoner GmbH), Dicrylan® thickener-O (ethylene oxide adduct, 50% active in water/isopropanol, Pfersse Chemie), EMA®-81 and EMA®-91 (ethylene-maleic anhydride copolymer, Monsanto), thickener-QR-1001 (polyurethane emulsion, 19-21% active in water/diglycol ether, Rohm & Haas), Mirox®-AM (anionic acrylic acid-acrylic ester copolymer dispersion, 25% active in water, Stockhausen), SER-AD-FX-1100 (hydrophobic urethane polymer, Servo Delden), Shellflo®-S (high molecular weight polysaccharide, stabilized with formaldehyde, Shell) and Shellflo®-XA (xanthan biopolymer, stabilized with formaldehyde, Shell).

Abrasive Materials

In certain embodiments, the compositions of the present invention may further comprise one or more abrasives (as used herein, interchangeable with the term "abrasive material"). Examples of suitable abrasives include particles such as, e.g., calcium carbonate, pumice stone, calcite, dolomite, feldspar, talc, alumina, silica, quartz, perlite, zirconium silicate and diatomaceous earth and organic materials such as melamine, resins such as urea formaldehyde resins, polyethylene beads and polyamide derivatives.

In certain embodiments, the abrasive is present in an amount of about 0.01% to about 3%, about 0.1% to about 1.5% or about 0.25 to about 1% of the composition.

The final ingredient in the cleaning compositions of the present invention is water. The proportion of water in the compositions generally is in the range of about 35% to 90% or about 50% to 85% by weight of the cleaning composition.

The stabilized compositions may optionally contain one or more additional surfactants such as anionic, amphoteric, zwitterionic, nonionic, cationic, or combinations thereof.

The anionic surfactant may be any anionic surfactant known or previously used in the art of aqueous surfactant compositions. Suitable anionic surfactants include but are not limited to alkyl sulfates, alkyl ether sulfates, alkaryl sulfonates, alkyl succinates, alkyl sulfosuccinates, N-alkoyl sarcosinates, alkyl phosphates, alkyl ether phosphates, alkyl ether carboxylates, alkylamino acids, alkyl peptides, alkoyl taurates, carboxylic acids, acyl and alkyl glutamates, alkyl isethionates, and alpha-olefin sulfonates, especially their sodium, potassium, magnesium, ammonium and mono-, di- and triethanolamine salts. The alkyl groups generally contain from 8 to 18 carbon atoms and may be unsaturated. The alkyl ether sulfates, alkyl ether phosphates and alkyl ether carboxylates may contain from 1 to 10 ethylene oxide or propylene oxide units per molecule, and in certain embodiments contain 1 to 3 ethylene oxide units per molecule.

Examples of suitable anionic surfactants include sodium and ammonium lauryl ether sulfate (with 1, 2, and 3 moles of ethylene oxide), sodium, ammonium, and triethanolamine lauryl sulfate, disodium laureth sulfosuccinate, sodium cocoyl isethionate, sodium C12-14 olefin sulfonate, sodium laureth-6 carboxylate, sodium C12-15 pareth sulfate, sodium methyl cocoyl taurate, sodium dodecylbenzene sulfonate, sodium cocoyl sarcosinate, triethanolamine monolauryl phosphate, and fatty acid soaps.

The nonionic surfactant can be any nonionic surfactant known or previously used in the art of aqueous surfactant compositions. Suitable nonionic surfactants include but are not limited to aliphatic ($C_6$-$C_{18}$) primary or secondary linear or branched chain acids, alcohols or phenols, alkyl ethoxylates, alkyl phenol alkoxylates (especially ethoxylates and mixed ethoxy/propoxy), block alkylene oxide condensate of alkyl phenols, alkylene oxide condensates of alkanols, ethylene oxide/propylene oxide block copolymers, semi-polar nonionics (e.g., amine oxides), as well as alkyl amine oxides. Other suitable nonionics include mono or di alkyl alkanolamides and alkyl polysaccharides, sorbitan fatty acid esters, polyoxyethylene sorbitan fatty acid esters, polyoxyethylene sorbitol esters, polyoxyethylene acids, and polyoxyethylene alcohols. Examples of suitable nonionic surfactants include coco mono or diethanolamide, coco diglucoside, alkyl polyglucoside, cocamidopropyl and lauramine oxide, polysorbate 20, ethoxylated linear alcohols, cetearyl alcohol, lanolin alcohol, stearic acid, glyceryl stearate, PEG-100 stearate, and oleth 20.

Amphoteric and zwitterionic surfactants are those compounds which have the capacity of behaving either as an acid or a base. These surfactants can be any of the surfactants known or previously used in the art of aqueous surfactant compositions. Suitable materials include but are not limited to alkyl betaines, alkyl amidopropyl betaines, alkyl sulphobetaines, alkyl glycinates, alkyl carboxyglycinates, alkyl amphopropionates, alkyl amidopropyl hydroxysultaines, acyl taurates and acyl glutamates wherein the alkyl and acyl groups have from 8 to 18 carbon atoms. Examples include cocoamidopropyl betaine, sodium cocoamphoacetate, cocoamidopropyl hydroxysultaine, and sodium cocoamphopropionate.

The cationic surfactants can be any of the cationic surfactants known or previously used in the art of aqueous surfactant compositions. Suitable cationic surfactants include but are not limited to alkyl amines, alkyl imidazolines, ethoxylated amities, quaternary compounds, and quaternized esters. In addition, alkyl amine oxides can behave as a cationic surfactant at a low pH. Examples include lauramine oxide, dicetyldimonium chloride, and cetrimonium chloride.

Other surfactants that can be utilized in the present invention are set forth in more detail in WO 99/21530, U.S. Pat. No. 3,929,678; U.S. Pat. No. 4,565,647; U.S. Pat. No. 5,720,964; and U.S. Pat. No. 5,858,948. Other suitable surfactants are described in McCutcheon's Emulsifiers and Detergents (North American and International Editions, by Schwartz, Perry and Berch), which is hereby fully incorporated by reference.

While amounts of the additional optional surfactant can vary widely, in various embodiments the total amount of additional optional surfactant is about 0.1% to about 20%, about 0.5% to about 15%, about 1% to about 10%, or about 1.5% to about 8% of the total weight of the composition.

In addition to the previously mentioned essential and optional constituents of the composition, one may also employ normal and conventional adjuvants, provided they do not adversely affect the properties of the detergent. Thus, for example, cationic antibacterial agents, coloring agents, perfumes; polyethylene glycol, ultraviolet light absorbers such as the Uvinuls, which are products of GAF Corporation; pH modifiers and the like may additionally be included. The proportion of such adjuvant materials, in total will normally not exceed 15% by weight of the composition, and in certain embodiments the percentages of illustrative examples of such individual components will be about 5% by weight. Sodium formate or formalin or Quaternium 15 (Dowicil 75) may be included in the formula as a preservative at a concentration of about 0.1% to 4.0% in certain embodiments.

In certain embodiments, the compositions of the invention may also contain other components either to provide additional effect or to make the product more attractive to the consumer. The following are mentioned by way of example: colors such as pigments or dyes in amounts of up to about 0.5% by weight; bactericides in amounts of up to about 1% by weight; preservatives or antioxidizing agents, such as formalin, 5-bromo-5-nitro-dioxin-1,3; 5-chloro-2-methyl-4-isothaliazolin-3-one, 2,6-di-tert.butyl-p-cresol, in amounts of up to about 2% by weight; pH adjusting agents, such as sulfuric acid or sodium hydroxide, as needed; perfumes or oils in amounts up to about 5% by weight. Furthermore, if opaque compositions are desired, up to about 4% by weight of an opacifier may be added.

The compositions of the present invention have a wide number of applications such as personal care applications, home care applications, industrial and institutional applications, textile applications and the like. Examples of home care applications include products such as: home care and industrial and institutional applications, such as laundry detergents; dishwashing detergents (automatic and manual); hard surface cleaners; hand soaps, cleaners and sanitizers, and the like.

The present cleaning compositions are readily made by simple mixing methods from readily available components which, on storage, do not adversely affect the entire composition. Because the compositions as prepared in certain embodiments are aqueous liquid formulations and since no particular mixing is required to form them, the compositions are easily prepared simply by combining all the ingredients in a suitable vessel or container. The order of mixing the ingredients is not particularly important and generally the various ingredients can be added sequentially or all at once or in the form of aqueous solutions of each or all of the surfactants can be separately prepared and combined with each other. It is not necessary to use elevated temperatures in the formation step and room temperature is sufficient.

The viscosity of the composition desirably will be at least about 100 centipoise (cps) at room temperature, but may be up to about 1,000 centipoise as measured with a Brookfield Viscometer using a number 21 spindle rotating at 20 rpm. In embodiments directed to a light duty liquid composition, the viscosity of the composition may approximate those of commercially acceptable light duty liquid compositions. In certain embodiments, the viscosity of the composition itself remains stable on storage for lengthy periods of time, without color changes or settling out of insoluble materials. In certain embodiments, the pH of the composition may be about 3 to about 8. The pH of the composition may be adjusted by the addition of a base, such as, e.g., $Na_2O$ (caustic soda) to the composition.

The following examples illustrate liquid cleaning compositions according to the present invention. Unless otherwise specified, all percentages are by weight. The exemplified compositions are illustrative only and do no limit the scope of the invention. It will be understood by those of skill in the art that numerous and various modifications can be made without departing from the spirit of the present invention.

Example 1

Formulation 1 according to the present invention was formulated as follows. All percentages are shown by weight.

TABLE 1

| Ingredients | Formulation 1 |
|---|---|
| Linear alkyl benzene sulfonate | 2.1% |
| C9-C11 alcohol with 8 ethoxylates | 3.7% |
| Maleic olefin copolymer | 0.6% |
| Fatty acid or a salt thereof | 0.4% |
| Polyacrylamide flocculant polymer (clean water) | nil |
| Sodium silicate | 2% |
| Minors, water | to 100% |

Example 2

Formulas 2 and 3 were prepared according to the present invention, as shown below in Table 2. All percentages are shown by weight.

TABLE 2

| Ingredients | Formulation 2 | Formulation 3 |
|---|---|---|
| Linear alkyl benzene sulfonate | 1.8% | 1.8% |
| C9-C11 alcohol with 8 ethoxylates | 2.5% | 2.5% |
| Maleic olefin copolymer | 0.2% | 0.2% |
| Fatty acid or a salt thereof | 0.2% | 0.2% |
| Sodium Cumene Sulfonate | 1% | 1% |
| Polyacrylamide flocculant polymer (clean water) | nil | nil |
| Sodium silicate, sodium carbonate, sodium citrate, ethanolamine | nil | 0.01-5% |
| Minors, water | to 100% | to 100% |

Example 3

Formulations 4, 5 and 6 were prepared according to the present invention, as shown below in Table 3. All percentages are shown by weight.

TABLE 3

| Ingredients | Formulation 4 | Formulation 5 | Formulation 6 |
|---|---|---|---|
| Linear alkyl benzene sulfonate | 1.8% | 2.6% | 2.6% |
| C9-C11 alcohol with 8 ethoxylates | 3.2% | 3% | 3% |
| Maleic olefin copolymer | 0.5% | 0.3% | 0.3% |
| Fatty acid or a salt thereof | 0.3% | 0.3% | 0.3% |
| Sodium Cumene Sulfonate | nil | nil | nil |
| Polyacrylamide flocculant polymer (clean water) | nil | nil | nil |
| Sodium silicate, sodium carbonate, sodium citrate, ethanolamine | nil | nil | 0.01-3% |
| Minors, water | to 100% | to 100% | to 100% |

Example 4

Formulations 7 and 8 were prepared according to the present invention, as shown in Table 4. All percentages are shown by weight.

TABLE 4

| Ingredients | Formulation 7 | Formulation 8 |
|---|---|---|
| Linear alkyl benzene sulfonate | 2.6% | 2.6% |
| C9-C11 alcohol with 8 ethoxylates | 4.5% | 4.5% |
| Maleic olefin copolymer | 0.7% | 0.7% |
| Fatty acid or a salt thereof | 0.5% | 0.5% |
| Polyacrylamide flocculant polymer (clean water) | nil | nil |
| Ethanolamine | 2% | 2% |
| Thickening agent (xanthan gum) | nil | 0.5% |
| Amorphous Silica | nil | 0.5% |
| Minors, water | to 100% | to 100% |

What is claimed is:

1. A cleaning composition comprising:
(i) an ethoxylated or propoxylated nonionic surfactant;
(ii) an anionic surfactant other than a fatty acid soap;
(iii) an olefin/maleic acid copolymer that consists of a $C_8$ olefin/maleic acid copolymer;
(iv) a fatty acid or a salt thereof;
(v) an alkaline builder;
(vi) a thickening agent; and
(vii) an abrasive material.

2. The composition of claim 1, wherein the ethoxylated or propoxylated nonionic surfactant is a C9-C11 alcohol ethoxylate.

3. The composition of claim 1, wherein the alkaline builder is chosen from alkali metal or alkaline earth metal phosphates, pyrophosphates, phosphonates, citrates, silicates, borates, carbonates, hydroxides, bicarbonates; monoethanolamine, diethanolamine, triethanolamine; sodium tripolyphosphate; trisodium phosphate; tetrasodium pyrophosphate; sodium acid pyrophosphate; sodium monobasic phosphate; sodium dibasic phosphate; sodium hexametaphosphate; sodium metasilicate; sodium silicates; sodium carbonate; sodium sulfate; borax (sodium tetraborate); ethylene diamine tetraacetic acid tetrasodium salt; and trisodium nitrilotriacetate.

4. The composition of claim 1, further comprising a solubilizing agent chosen from ethanol, hexylene glycol, pentaethylene glycol hexyl ether, triethylene glycol hexyl ether, sodium chloride, sodium cumene sulfonate, sodium xylene sulfonate or a mixture thereof.

5. The composition of claim 1, wherein the fatty acid or a salt thereof is a $C_{10}$-$C_{22}$ carboxylic acid sodium salt.

6. The composition of claim 1, wherein the thickening agent is chosen from an inorganic clay or a natural gum.

7. The composition of claim 1, wherein the abrasive material is chosen from chalk, silica, alumina, sodium silicate, zirconium silicate, sodium carbonate, sodium citrate or a mixture thereof.

8. The composition of claim 1, wherein the anionic surfactant is present in an amount of about 0.1% to about 8%.

9. The composition of claim 1, wherein the ethoxylated or propoxylated nonionic surfactant is present in an amount of about 0.1% to about 10%.

10. The composition of claim 1, wherein the copolymer is present in an amount of about 0.01% to about 3%.

11. The composition of claim 1, wherein the alkaline builder is present in an amount of about 0.01% to about 3%.

12. The composition of claim 1, wherein the thickening agent is present in an amount of about 0.01% to about 2%.

13. The composition of claim 1, wherein the abrasive material is present in an amount of about 0.01% to about 3%.

14. The composition of claim 1, wherein the fatty acid or a salt thereof is present in an amount of about 0.01% to about 3%.

15. A cleaning composition comprising:
(i) about 0.1% to about 10% ethoxylated or propoxylated nonionic surfactant;
(ii) about 0.01% to about 8% anionic surfactant;
(iii) about 0.01% to about 3% olefin/maleic acid copolymer that consists of a $C_8$ olefin/maleic acid copolymer;
(iv) about 0.01% to about 3% of a $C_{10}$-$C_{22}$ carboxylic acid sodium salt;
(v) about 0.01% to about 3% of an alkaline builder chosen from alkali metal or alkaline earth metal phosphates, pyrophosphates, phosphonates, citrates, silicates, borates, carbonates, hydroxides, bicarbonates; monoethanolamine, diethanolamine, triethanolamine; sodium tripolyphosphate; trisodium phosphate; tetrasodium pyrophosphate; sodium acid pyrophosphate; sodium monobasic phosphate; sodium dibasic phosphate; sodium hexametaphosphate; sodium metasilicate; sodium silicates; sodium carbonate; sodium sulfate; borax (sodium tetraborate); ethylene diamine tetraacetic acid tetrasodium salt; and trisodium nitrilotriacetate;
(vi) about 0.01% to about 3% xanthan gum; and
(vii) about 0.01% to about 3% abrasive material chosen from chalk, silica, alumina, sodium silicate, zirconium silicate, sodium carbonate, sodium citrate or a mixture thereof.

16. A method of making a detergent comprising combining the following:
(i) about 0.01% to 8% anionic surfactant;
(ii) about 0.1% to 10% ethoxylated or propoxylated nonionic surfactant;
(iii) about 0.01% to 3% olefin/maleic acid copolymer that consists of a $C_8$ olefin/maleic acid copolymer;
(iv) about 0.01% to 3% fatty acid or a salt thereof;
(v) about 0.01% to 3% alkaline builder;
(vi) about 0.01% to 3% thickening agent; and
(vii) about 0.01% to 3% abrasive material.

17. A method of cleaning a household surface, comprising applying the composition of claim 1 to the household surface and rinsing or wiping the household surface.

* * * * *